US007673399B2

(12) United States Patent
Garcia-Perez Aradros

(10) Patent No.: US 7,673,399 B2
(45) Date of Patent: Mar. 9, 2010

(54) SELF-VENTILATED, ERGONOMIC FOOTWEAR AND SOLE

(75) Inventor: Basilio Garcia-Perez Aradros, Arnedo (ES)

(73) Assignee: Calzados Hergar, S.A., Arnedo (ES)

( * ) Notice: Subject to any disclaimer, the term of this patent is extended or adjusted under 35 U.S.C. 154(b) by 762 days.

(21) Appl. No.: 10/599,191

(22) PCT Filed: Jan. 14, 2005

(86) PCT No.: PCT/ES2005/000018

§ 371 (c)(1),
(2), (4) Date: Sep. 22, 2006

(87) PCT Pub. No.: WO2005/092137

PCT Pub. Date: Oct. 6, 2005

(65) Prior Publication Data

US 2008/0244929 A1 Oct. 9, 2008

(30) Foreign Application Priority Data

Mar. 25, 2004 (ES) ..... 200400736 U
Mar. 25, 2004 (ES) ..... 200400737 U

(51) Int. Cl.
*A43B 3/26* (2006.01)

(52) U.S. Cl. ..... 36/97; 36/3 B; 36/29; 36/102

(58) Field of Classification Search ..... 36/97, 36/3 B, 29, 102, 25 R, 28
See application file for complete search history.

(56) References Cited

U.S. PATENT DOCUMENTS 3,670,429 A 6/1972 Anarosiglio
4,438,573 A 3/1984 McBarron
4,967,492 A * 11/1990 Rosen ..... 36/97
6,115,945 A * 9/2000 Ellis, III ..... 36/102
7,430,817 B2 * 10/2008 Abadjian et al. ..... 36/29
2002/0088145 A1 * 7/2002 Clark et al. ..... 36/97
2005/0257405 A1 * 11/2005 Kilgore ..... 36/97

FOREIGN PATENT DOCUMENTS

DE 10241961 A 3/2004
EP 1118280 A 3/2004
GB 763878 A 12/1956
JP 2003102502 A 4/2003

* cited by examiner

*Primary Examiner*—Ted Kavanaugh
(74) *Attorney, Agent, or Firm*—Lucas & Mercanti, LLP

(57) ABSTRACT

The invention relates to a self-ventilated, ergonomic footwear item and elastomeric sole. According to the invention, both sides of the sole comprise a plurality of longitudinal grooves, in the area corresponding to the sole of the foot, which are essentially parallel to the edge of the sole closest thereto and which have a depth equal to half of the height of the sole. Moreover, the grooves are disposed in an alternating manner in relation to one another on either side of the sole in the form of a bellows-type structure. The upper comprises a perforated elastic laminar body which is disposed beneath the insole in the area corresponding to the sole and the foot and which, together with the sole, forms a chamber having a volume that varies upon walking. In addition, three thick bands are solidly connected to the body and the upper in order to stiffen said elastic laminar body, namely: one longitudinal band and two transverse end bands. In this way the footwear item and the sole adapt perfectly to the anatomy of the foot, enabling same to be automatically ventilated upon walking.

7 Claims, 2 Drawing Sheets

SELF-VENTILATED, ERGONOMIC FOOTWEAR AND SOLE

OBJECT OF THE INVENTION

The present invention relates to footwear and a sole which said footwear comprises but which can be applied to other types of footwear. On the one hand, the footwear offers optimum performance from an ergonomic point of view adapting itself perfectly to the user's foot irrespective of the different relation between the length and width of said foot due to an elastomeric sole or the like, generally obtained by means of injection moulding, subsequently covered by means of an insole and combined with the corresponding upper to finish the footwear, and on the other hand allowing for inner ventilation which is automatically generated on walking, also improving comfort in this aspect.

Thus, the object of the invention is to obtain footwear offering the user thereof greater comfort, both from the point of view of the comfortable adaptation to his feet and also the ventilation thereof, and a sole which in the area corresponding to the sole of the foot has a high degree of elastic deformability in the transverse direction in order to enhance the comfort of the footwear for the user, anatomically adapting itself to the feet thereof, irrespective of their greater or lesser width.

BACKGROUND TO THE INVENTION

Within the scope of footwear, and more specifically of soles for same, one of the solutions normally used is that in which the sole is obtained by means of injection moulding from elastomeric materials.

The outsoles are manufactured according to pre-established sizes, based on a stepped table of foot lengths, such that any person can find shoes in the market with a size suited to the length of his feet.

The same does not apply regarding the transverse elevation, as this is usually fixed for a certain type or design of footwear, which as is known means a serious problem for those having "wide feet", who are forced to bear the discomfort of shoes which "pinch them" or are forced to use a larger size than they should depending on the length of the foot, because evidently as the size of the footwear increases, the width thereof increases in parallel.

The solution to this problem is to use lasts of different widths, this evidently having very negative effects from an economic point of view, specifically from the point of view of manufacturing and distribution costs.

A less encumbering solution is to use uppers based on soft materials, which partially resolves the problem, especially when the user's feet are not much wider than normal, but this leads to a deformation of the footwear making it lose its original appearance completely after a short period of use.

On the other hand, due to their very nature, these elastomeric soles offer virtually no degree of transpiration, such that they retain the user's body sweat, it thus being desirable to have an inner ventilation of the footwear for evaporating the sweat as it is produced.

Footwear provided with means of inner ventilation exists on the market, but the solutions adopted up to the present are structurally complex and functionally rather ineffective, thus their practical use is determined more by advertising propaganda than by a real effectiveness to that respect.

DESCRIPTION OF THE INVENTION

The footwear and the sole proposed by the invention resolves in a fully satisfactory manner the problems set forth hereinbefore in the two aspects discussed, so that in addition to offering optimum performance from the ergonomic point of view, perfectly adapting themselves to the anatomy of the user's foot, it allows said ventilation which occurs automatically when walking.

To that end and more specifically, the footwear of the invention, based on the use of an elastomeric sole obtained for example by means of injection moulding, combines special features of said sole with other features affecting its complementary upper and allowing the effects sought to be obtained.

Specifically, the sole is provided with longitudinal grooves in the area corresponding to the sole of the foot, that is, extending between the toe and the start of the waist, operatively arranged both on its upper or inner side and on its lower or outer side, which grooves affect about half the thickness of the sole in this area, said plurality of longitudinal grooves, preferably of an arched path, that is parallel to the side edges of the sole in its area of location, with the special particularity that the grooves of its upper side are transversely staggered with respect to those of the lower side, such that this area of the sole configures a type of bellows allowing elastic deformation in the transverse direction of the sole in said area of the sole of the foot due to the pressure exerted by the foot depending on the width of the latter which is obviously where the problems derived from "wide feet" occur.

Accordingly, the original dimensions of the width of the sole in the area corresponding to the sole of the foot are maintained when the user has a normal foot width, but faced with the needs of a wider foot an easy transverse dilation of the sole in this area of the sole of the foot occurs, that is, a widening thereof occurs, suiting it to the needs of the foot, conferring the footwear with a high degree of comfort.

This greater comfort can be extended to any type of user because the same elastic deformability occurs under normal conditions, making the footwear much more comfortable as it has a "softer" sole without changing the material.

Complementarily, the upper which is closed in the lower portion and, as is usual, by means of an insole, also incorporates in the area of the sole of the foot an elastic body, which due to its own nature favours the elastic deformation in the transverse direction of the footwear in this repeatedly said area of the sole of the foot, and which further incorporates openings suitably distributed for the entrance and exit of air. A chamber is thus created between the elastic body and the sole the volume of which changes upon walking due to the expansion and contraction of the elements making it up, which volumetric variation leads to a "lung" effect such that the air enters and exits said chamber, causing the sought ventilation of the foot in the area of the footwear which is the most problematic to that respect, that is in the closed area of the sole of the foot, because ventilation usually occurs in the heel area through the foot access opening.

DESCRIPTION OF THE DRAWINGS

To accompany the description being made and for the purpose of better understanding the features of the invention, according to a preferred practical embodiment thereof, a set of drawings is attached as an integral part of said description in which, with an illustrative and non-limiting character, the following is shown.

PREFERRED EMBODIMENT OF THE INVENTION

Figure 1:
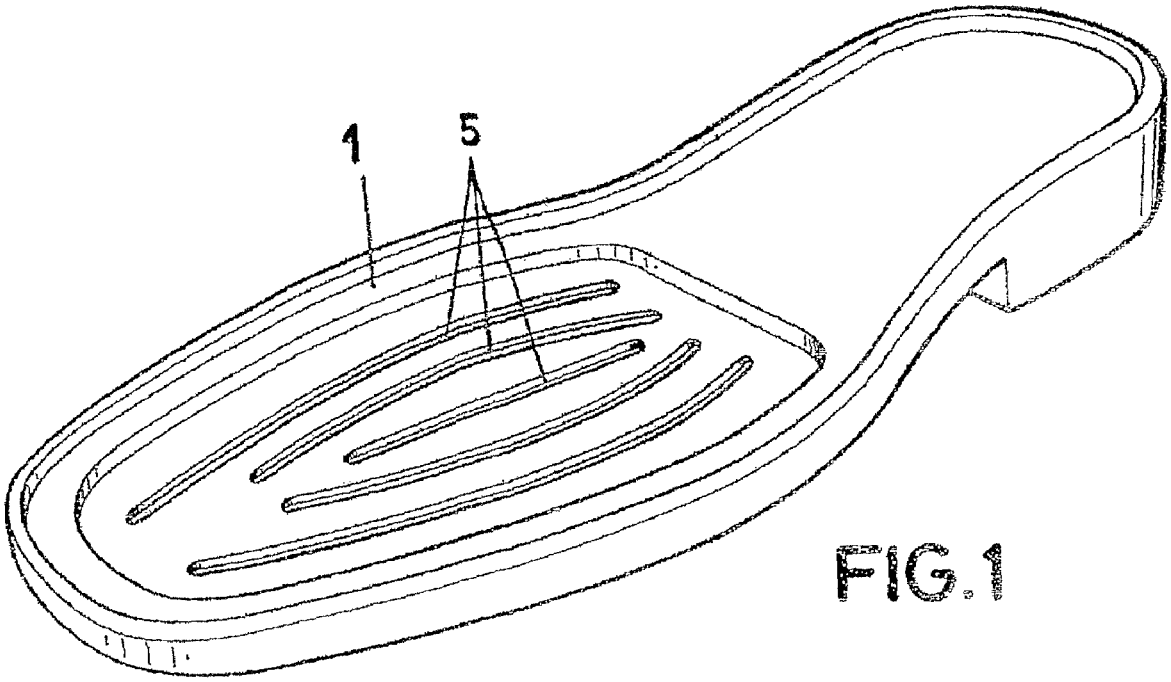
FIG. 1 shows a schematic perspective illustration of a sole for footwear carried out according to the object of the present invention, showing the upper side thereof.
Figure 2:
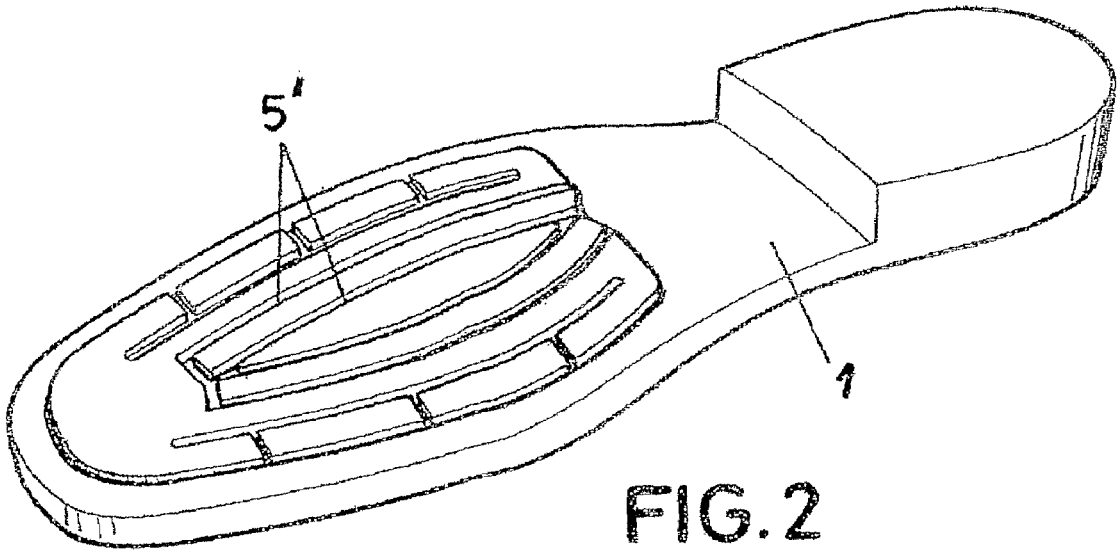
FIG. 2 shows an illustration similar to the previous figure, but in which the lower side of the sole is shown.

In view of FIGS. 1 and 2, it can be seen how the sole (1) proposed by the invention is, like any conventional sole, made up of a one-piece body with the classic sections corresponding to the sole of the foot, to the waist and to the heel, these sections being able to adopt, particularly as regards the outer side shown in FIG. 2, any type of surface finish or configuration in accordance with the design provided for the sole.

The invention centres on the fact that the sole (1) incorporates on its inner side and in the area corresponding to the sole of the foot, a plurality of uniformly distributed longitudinal grooves (5) which, in the practical embodiment shown in the drawing, are five in number, but this number can vary without this affecting the essence of the invention, which grooves are preferably curved and parallel to the side edge and next to the body of the sole.

Figure 4:
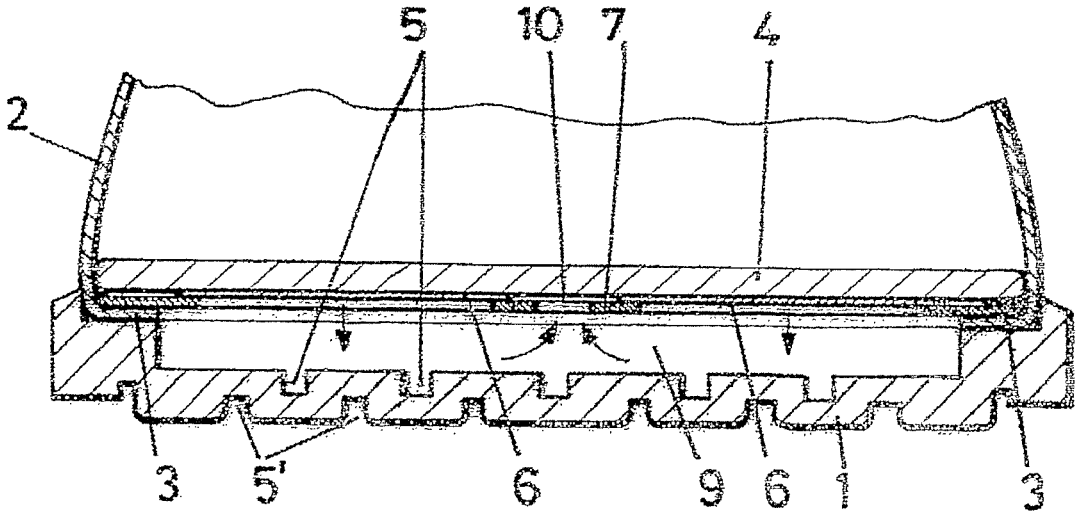
FIG. 4 sows a cross section detail of the assembly represented in the previous figure, duly assembled.

Said grooves (5) of the upper side of the sole are complemented with other lower grooves (5') which must necessarily be arranged in an alternating manner with respect to the upper grooves (5), as can be observed perfectly in FIG. 4, for which reason there must be a higher or lower number of lower grooves than upper grooves (5), the number being greater in the chosen practical embodiment, specifically six.

The depth of the grooves (5) and (5'), in relation to the thickness of the sole in this area of the sole of the foot must be such that it affects about half of said thickness in order to obtain the bellows-type structure shown in FIG. 4 which, providing the sole with the suitable formal stability, nevertheless allows that, in the specific case of a "wide feet" user, the sole can be elastically deformed in the sense of transverse widening to perfectly adapt itself to the dimensional demands of the foot as previously stated.

Obviously this elastic deformation of the sole (1) in the area corresponding to the sole of the foot is not obstructed by the classic insole internally covering or by the upper of the footwear, because both are easily deformable.

Evidently said grooves (5) and (5') affect neither the waist nor the heel given that these areas of the footwear do not usually present any problems for people with "wide feet", in which the excessive width of the feet occurs exactly in the area corresponding to the sole of the foot.

Figure 3:
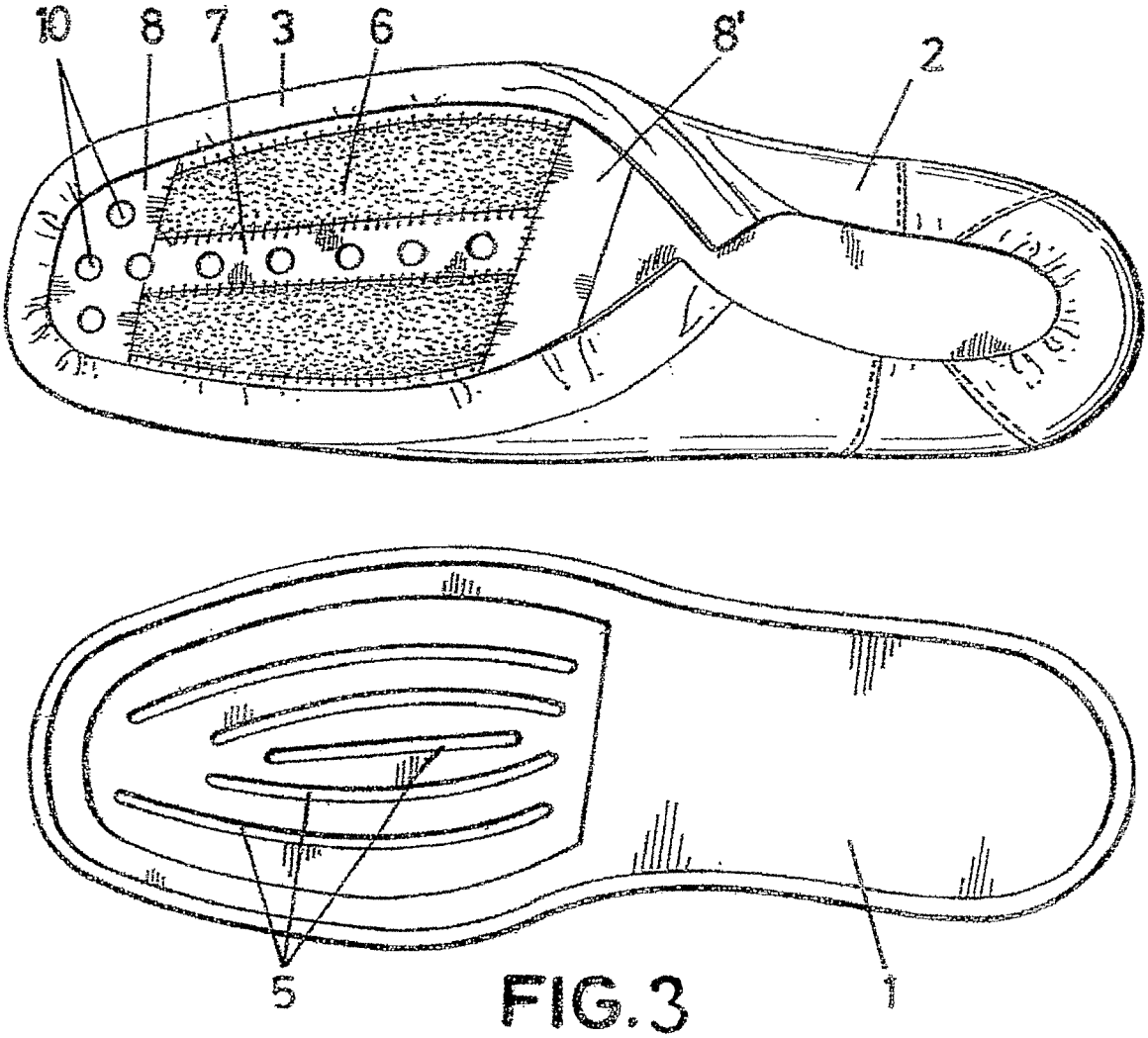
FIG. 3 shows an exploded plan view of a self-ventilated ergonomic footwear carried out according to the object of the present invention in which both the upper of the footwear and the sole thereof show the sides through which they must be adapted and fixed.

In view of FIGS. 3 and 4 it can be seen how the footwear proposed by the invention is formed, like any conventional footwear, by means of the combination of a sole (1) and an upper (2), the latter having a lower inner perimetral edge (3) for its adaptation and fixing to the sole (1) by any appropriate means, the classic insole (4) suitably isolating the user's foot from the sole (1) and which can optionally be covered by another insole for decorative purposes, being arranged on the inside of the upper (2).

Complementarily in the upper (2) and also in the area corresponding to the sole of the footwear, specifically under the insole (4), a laminar elastic body (6) is arranged, suitably fixed at its contour to the upper (2), for example, to the previously mentioned perimetral edge (3), which elastic body (6) allows and favours deformation in the transverse direction of the footwear, and which according to a preferred practical embodiment will be stiffened by means of a longitudinal band (7) and a pair of transverse end bands (8-8'), perfectly visible in FIG. 1, fixed both to the elastic laminar body (6) and, where appropriate, to the edge (3) of the upper, these bands (7-8) having the purposes of suitably stabilizing the elastic body (6), defining therein two independent side deformation areas.

On the other hand, the thickness of these bands (7-8) favours the arrangement of the variable volume chamber (9) between the elastic body (6) and the sole (1), the volume of which will decrease when supporting the foot on the ground, the air exiting said chamber through a plurality of openings (10) arranged in the bands (7) and (8) with air penetrating into the useful inside of the footwear, whereas an increase in the volume of the chamber (9) and an aspirating effect occurs when lifting the foot from the ground and due to the elastic recovery of the body (6).

Therefore, and according to the described structure, the grooves (5-5') of the sole (1) and the elastomeric nature thereof, as described, allow the elastic deformation in the transverse direction of the sole so that the footwear comfortably adjusts to the user's feet, irrespective of the width thereof, whilst at the same time the chamber created between the elastic laminar body (6) and the sole itself, together with the openings (10) for communicating with the inside of the footwear, generate a ventilation in the latter, with a "lung"-type movement of air maximally increasing the comfort of the footwear as a whole.

The invention claimed is:

1. A self-ventilated, ergonomic footwear comprising:

an elastomeric sole; and an upper having at least one insole, wherein the sole comprises, in an area corresponding to a sole of a foot, a plurality of longitudinal grooves both on an inner and outer side of the sole, arranged in an alternating manner in relation to one another, determining a "bellows"-type structure;

the upper has, in the area corresponding to the sole of the foot and beneath the insole, an elastic laminar body;

a chamber formed between the elastic laminar body and the sole, the chamber having a volume that varies upon walking; and the elastic laminar body having openings which communicate the chamber to inside the footwear and allow passage of air in both directions.

2. The footwear of claim 1, wherein the grooves of the sole adopt a longitudinal arrangement essentially parallel to a longitudinal edge of the sole closest thereto and have a depth affecting about half a thickness of the sole.

3. The footwear of claim 1, wherein the elastic laminar body is stiffened by a longitudinal middle band and two transverse end bands, the end bands connected to the middle band and the end bands connected to the upper of the footwear, the openings for communicating with inside of the footwear being located in the middle band and the end bands.

4. A self-ventilated, ergonomic footwear, comprising:

an outer elastomeric sole; and an upper having at least one insole, wherein the upper comprises, between the outer sole and the insole, an elastic laminar body, a chamber formed between the outer sole and the elastic laminar body, the chamber having a volume that varies upon walking, the elastic laminar body having openings that communicate the chamber with inside of the footwear and allowing passage of air in both directions, wherein the elastic laminar body is stiffened by a longitudinal middle band and a pair of traverse end bands, one of the pair of end bands located at a level of a toe-cap and the other of the pair of end bands side in a rear side area of sector corresponding with a sole of a foot, the end bands connected to both the upper of the footwear and to the outer sole.

5. The footwear of claim 4, wherein the openings are located in the middle band and the end bands.

6. The footwear of claim 4, wherein the outer sole has, at a level of a sole of a foot, a plurality of longitudinal grooves both on an inner and outer side of the outer solo, arranged in an alternating manner in relation to one another, determining a "bellows"-type structure.

7. The footwear of claim 6, wherein the grooves of the outer sole are essentially parallel to a longitudinal edge of the outer sole closest thereto and have a depth approximately half a thickness of the outer sole.

* * * * *